US005421536A

United States Patent [19]

Hertel et al.

[11] Patent Number: 5,421,536

[45] Date of Patent: Jun. 6, 1995

[54] SURFACE WINDER WITH RECYCLED MANDRELS AND METHOD

[75] Inventors: James E. Hertel, Green Bay; Gerald W. Buxton, Shawano; Lawrence J. Oliver, Green Bay, all of Wis.

[73] Assignee: Paper Coverting Machine Company, Green Bay, Wis.

[21] Appl. No.: 93,342

[22] Filed: Jul. 19, 1993

[51] Int. Cl.[6] ..... B65H 35/04; B65H 19/30

[52] U.S. Cl. ..... 242/526.1; 242/533.4; 242/533.6; 242/542.3

[58] Field of Search ..... 242/56.8, 65, 66, 67.1 R, 242/68.4, 78.1, 78.6, 526.1, 533.4, 533.6, 542.3

[56] References Cited

U.S. PATENT DOCUMENTS

| | | | |
|---|---|---|---|
| Re. 28,353 | 4/1965 | Nystrand et al. . | |
| 2,870,840 | 1/1959 | Kwitek . | |
| 3,071,259 | 1/1963 | Nystrand et al. . | |
| 3,131,880 | 5/1964 | Miller et al. | 242/66 |
| 3,148,843 | 9/1964 | Turner et al. . | |
| 3,718,302 | 2/1973 | Mount et al. | 242/56.9 X |
| 3,823,887 | 7/1974 | Gerstein | 242/56.8 X |
| 4,783,015 | 11/1988 | Shimizu | 242/66 X |
| 4,828,195 | 5/1989 | Hertel et al. . | |
| 4,856,725 | 8/1989 | Bradley | 242/66 |
| 5,104,055 | 4/1992 | Buxton | 242/66 |
| 5,137,225 | 8/1992 | Biagiotti | 242/66 |

*Primary Examiner*—John P. Darling

*Attorney, Agent, or Firm*—Tilton, Fallon, Lungmus & Chestnut

[57] ABSTRACT

A surface winder and method employing recycled mandrels wherein a frame provides a winding path, a first winding drum for continuously advancing a web in the path and positioned on one side of the path, a mandrel inserter for introducing mandrels sequentially into the path for contact with the web, a second winding drum on the frame on the other side the path for coacting with the first winding drum in developing a log and a stripper on the frame for stripping each mandrel sequentially out of its associated log.

12 Claims, 3 Drawing Sheets

SURFACE WINDER WITH RECYCLED MANDRELS AND METHOD

BACKGROUND AND SUMMARY OF INVENTION

This invention relates to a surface winder with recycled mandrels and method and,, more particularly, to a surface winder wherein the web is enveloped directly around the mandrel so as to develop, in effect, a "coreless" log of convolutely wound material.

The invention is to provide a winder which employs "free" mandrels which are pulled out of the finished log and thereafter recycled into the winding process. Recirculated mandrels have been used for a long time—see U.S. Pat. No. 3,148,843.

The main objective of the invention is to produce a wound product without separate core material. It is also desirable to have a hole in the center of the product so that a variety of dispensers can be used. The hole is preferably small, in the range of 0.375 inches (about 10 mm) to 0.750 inches (about 20 mm), so that the rolls cut from the log are stable. By stable, we mean that the wound structure will not collapse or unravel internally during cutting, packaging, shipping, etc. Larger holes tend to require a "fixing agent" to stabilize the area near the "core".

Another objective is to wind these products in a high speed, continuous manner. Currently the products are wound onto free mandrels but in a start/stop operation. These winders are typically limited in production due to the need to decelerate the entire line (unwind, embosser, rewind) to zero web speed during the transfer process.

Typical center winder technology also does not respond to this need because the small diameter mandrels would not have adequate stiffness to rotate at high speeds. For a 100 inch (2.5 meters) wide winder running at 2,500 FPM (800 mpm) the minimum mandrel diameter is about 1.5 inches (38 mm). Hence, the combination of production requirements and small hole size negate the center winding option.

BRIEF DESCRIPTION OF DRAWING

The invention is described in conjunction with an illustrative embodiment in the accompanying drawing, in which.

DETAILED DESCRIPTION

Figure 1:
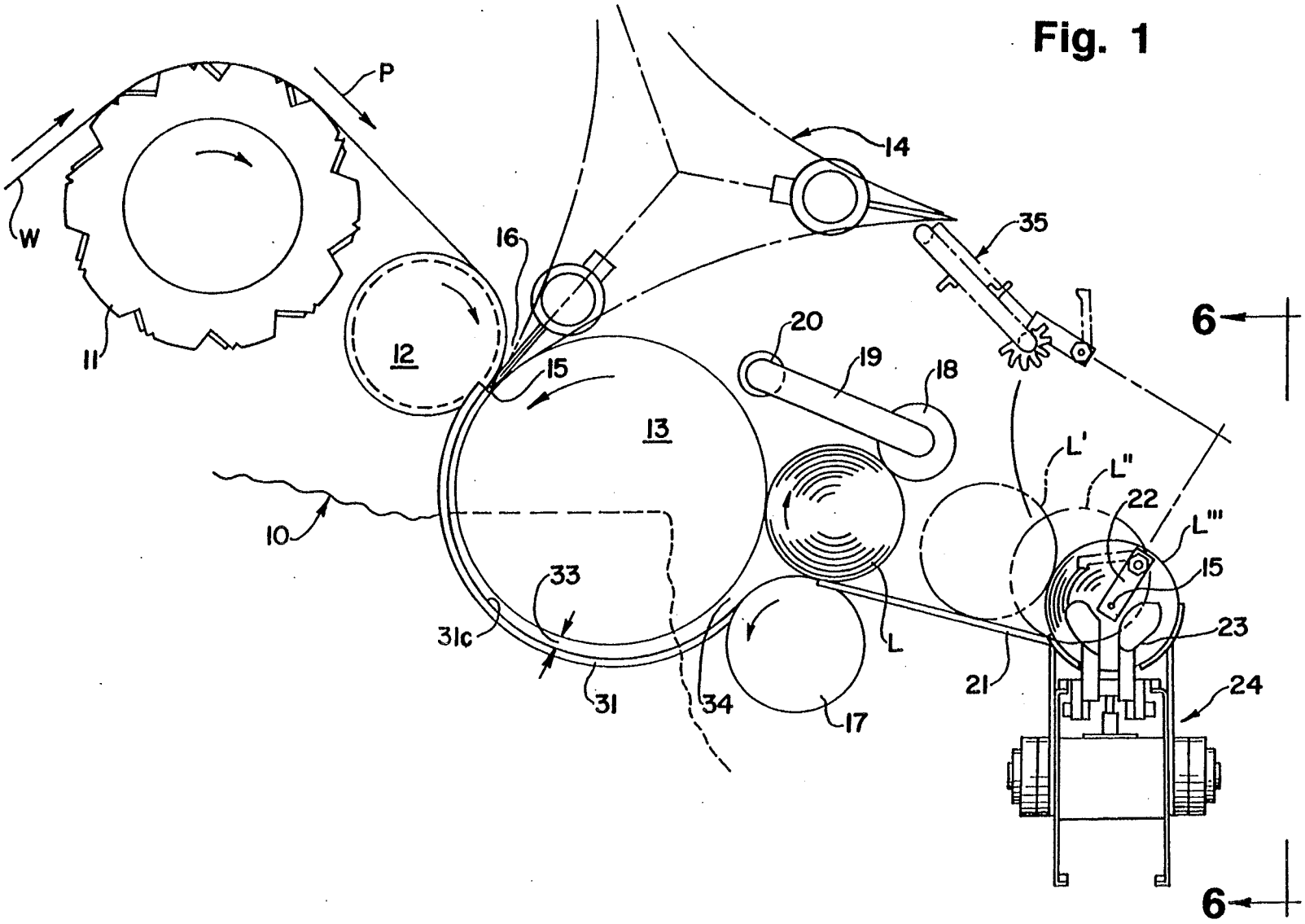
FIG. 1 is a fragmentary side elevational view, partially schematic, of the operational elements of the invention.
Figure 6:
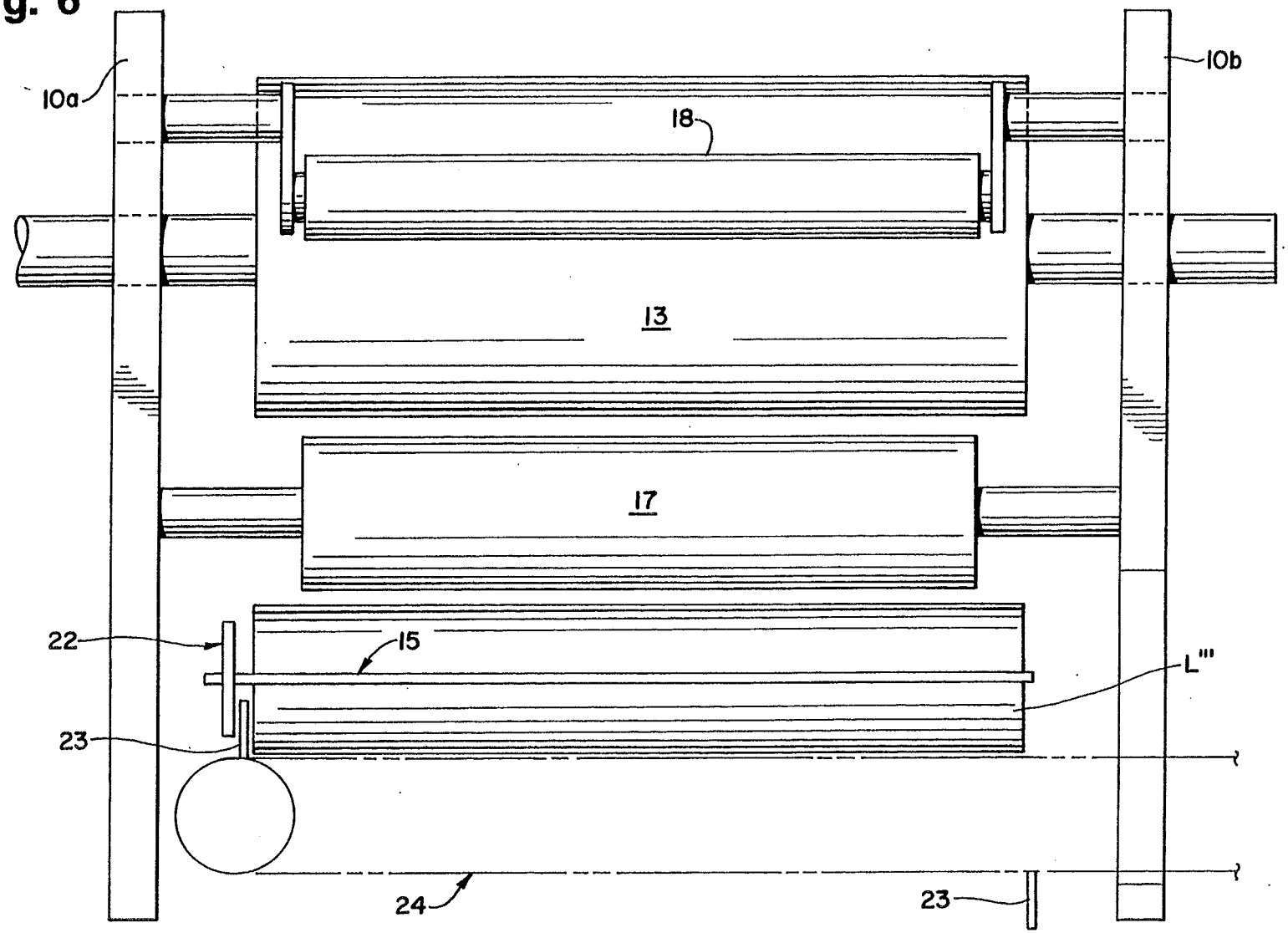
FIG. 6 is an end elevational view such as would be seen along the site line 6—6 applied to FIG. 1.

Referring first to FIG. 1, the numeral 10 designates generally a frame for the machine which is seen in FIG. 6 to include side frames 10*a* and 10*b*. As is conventional in the winder art, the side frames 10*a* and 10*b* rotatably support a plurality of rolls or drums for processing of a web and define essentially a winding path for the web in its travel from a parent roll (not shown) toward becoming a retail sized log of paper, other web material, foil, etc. For additional details of winders, reference may be made to co-owned patents RE 28,353 and U.S. Pat. No. 4,828,195.

Starting with the upper left hand portion of FIG. 1, the symbol W designates a web of material which is being advanced through a path designated in part by the symbol P and which first includes travel around a perforator roll 11 which operates against an anvil (not shown) to transversely perforate the web along equally longitudinal spaced lines of transverse perforation. Conventionally the spacing between lines of perforation in toilet tissues may range in different parts of the world from 4 to 5 inches (100–125 mm). Different spacing are employed for kitchen toweling. A suitable perforator is seen in co-owned U.S. Pat. No. 2,870,840.

The web W in continuing along the path P next encounters a lay-on roll designated 12 which again is suitably rotatably mounted like the other rolls or drums within the frames 10*a* and 10*b*. Positioned adjacent the lay-on roll 12 and still further in the path of travel of the web P is a first winding drum or bedroll generally designated 13.

Still referring to FIG. 1 and now above and slightly to the right of the bedroll 13 is a mandrel-introducing mechanism generally designated 14. In the illustration given, this is a hypocycloidal introducing mechanism of the nature shown in co-owned U.S. Pat. No. 4,856,725 which provides a gripping action on a cylindrical member.

The mechanism 14 functions to introduce a mandrel such as designated 15 into the nip 16 between the lay-on roll 12 and the bedroll 13. Thus, the mandrel 15 follows a portion of the winding path P inasmuch as the mandrel and the web are now proceeding together at least partway around the periphery of the first winding drum 13.

Before going into further details relationship of the mandrel 15 and first winding drum 13, we describe the remainder of the winding path P. After the mandrel proceeds around a portion of the periphery of the bedroll 13, it encounters the second winding drum or lower 17 which cooperates with the first winding drum or bedroll 13 in developing a full diameter log L of convolutely wound material. In conventional fashion, the log is maintained in what could be considered a three roll cradle by means of a pivotally mounted rider roll 18 which is mounted on arms 19. The arms 19 are fixed to a cross shaft 20 which is suitably journaled within the side frames 10*a*, 10*b*.

After the log L has been developed and a new mandrel is in the process of being wound, the log L rolls down a table 21 as indicated by the positions L′, L″ and finally L‴.

At this juncture, a stripping operation is performed wherein first the mandrel 15 which has an end protruding beyond the log L‴ (FIG. 6) is gripped by means of a jaw gripper 22. Between the adjacent end of the log L‴ and the gripper 22, a pusher 23 is interposed. The pushers 23 are carried by a conveyor mechanism generally designated 24 and operates to strip the log L‴ from the mandrel 15 by moving the same axially along the mandrel 15 and onto an extended portion of the conveyor 24 (see FIG. 6).

OPERATION

FIG. 1 shows the inventive winder using a very small diameter mandrel 15. The main objective of this winder is to produce a coreless roll with a very small hole in the center. For this purpose, the rotation of the bedroll 13, the operation of the core inserter 14 and the speed of advance of the web W are coordinated so that the bedroll 13, the mandrel 15 and the perforation register 25 are generally in the relation shown in FIG. 2. The bedroll 13 uses vacuum port means generally designated 26 and 27 to hold the web against the bedroll surface. The vacuum port 26 is seen to include two separate arrangements of axially extending ports in the outer surface of the bedroll 13. The port means 26 include a triple row of primary vacuum ports 28 and a secondary double row of vacuum ports 29. The ports 29 are arranged to circumferentially flank the primary vacuum ports 28. The double row of vacuum ports 27 is spaced forwardly in the direction of rotation from the first mentioned vacuum port means 26. The main port means 26 is channeled to two separate vacuum supplies (not shown) so that the outer rows of vacuum ports 29 can be vented independently from the inner row 28.

Figure 2:
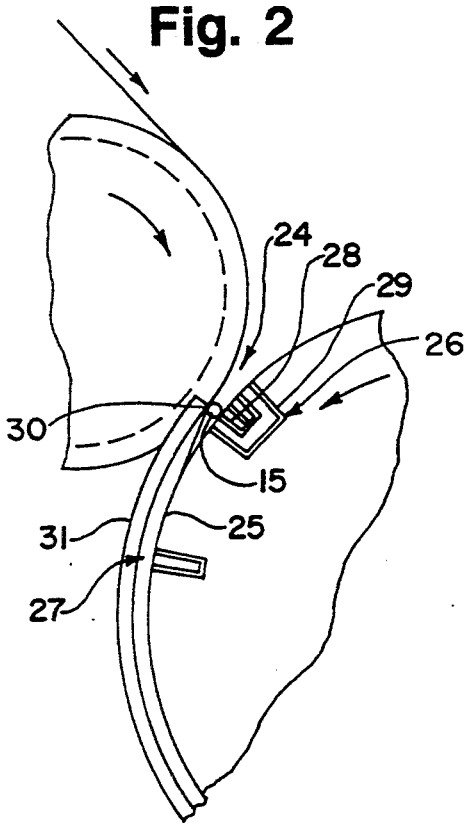
FIG. 2 is a fragmentary schematic elevational view of the elements in the central portion of FIG. 1 in the positions they assume at the beginning of a winding cycle.
Figure 3:
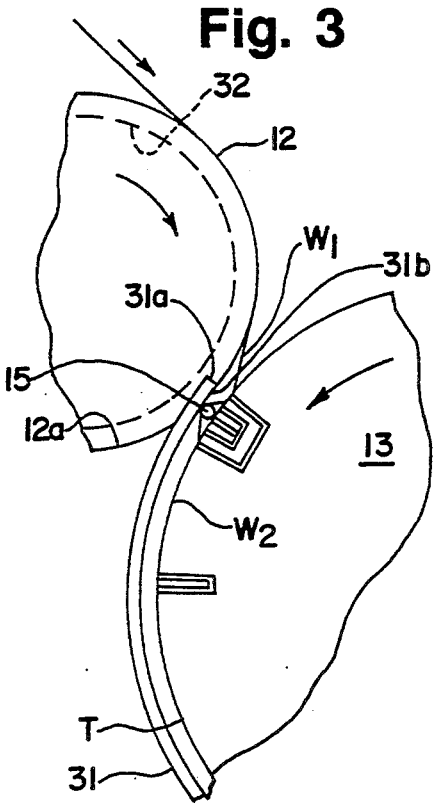
FIG. 3 is a view similar to FIG. 2 but slightly later in the winding cycle showing the leading edge portion of a severed web about to envelop an inserted mandrel.
Figure 4:
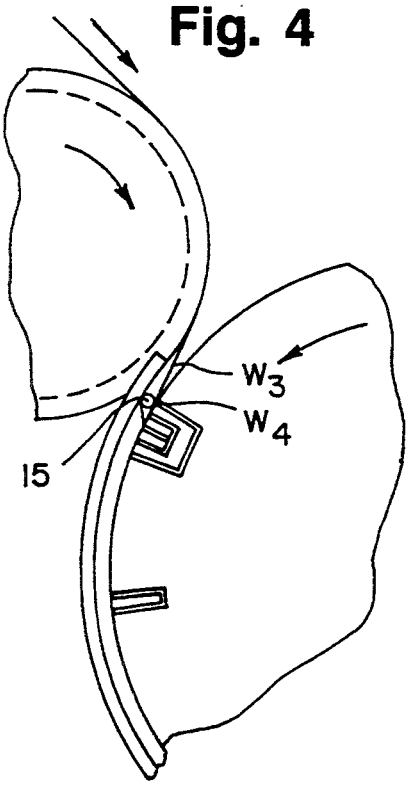
FIG. 4 is a view similar to FIGS. 2 and 3 but again somewhat later in the winding cycle.

As can be seen in FIGS. 2–4, the inventive transfer uses an arcuate stationery plate to produce a pinch cutoff. This is analogous to the structure described in co-owned U.S. Pat. No. 4,828,195 except that the targeted perforation is isolated in part by means of vacuum ports 27. These ports 27 hold the tail T (FIG. 3) of the just-finished log on the bedroll 13 so that severing takes place between the ports 27 and the pinch point 30 developed by the coaction of the mandrel 15 and the arcuate stationary plate 31.

It will be noted in FIG. 3, for example, that the lay-on roll 12 is equipped with an annular groove 32 in its outer surface which accommodates the inlet end 31*a* of the stationary plate 31. Thus, the inlet end 31*a* has a surface 31*b* facing the bedroll drum 13 which is essentially tangent with the outer surface 12*a* of the lay-on drum 12. This facilitates the introduction of the mandrel 15 by the inserter mechanism 14 because the mandrel 15 is then approaching a nip defined by adjacent rolls 12, 13 and, in part, by the stationary plate 31.

As seen in FIG. 3, the pinching of the web causes a small amount of slack as at $W_1$ to be formed between the lay-on roll 12 and the mandrel 15. This slack web is immediately attracted to the bedroll 13 by the vacuum port means 26 and also directed to the bedroll 13 and away from the lay-on roll 12 by the centrifugal force of the web on the lay-on roll 12. The vacuum port means 26 then pull the slack web $W_1$ under the rolling mandrel 15.

Just described is what happens to the web in the portion $W_1$ on the upstream side of the mandrel 15. Now turning to what happens to the portion of the web on the downstream side of the mandrel 15 which is designated $W_2$. This is the leading edge portion of the web which becomes the beginning of the next log of convolutely wound material. Although the web leading edge portion $W_2$ is being drawn toward the surface of the bedroll 13 by virtue of the vacuum port means 26, it is maintained in a relatively stationary relationship to the surface of the bedroll by virtue of the pinching occurring at the point 30 (FIG. 2). Thus the bedroll 13 continues to advance and slides underneath leading edge portion $W_2$ which remains substantially stationary during this time because it is still pinched against the stationary plate at the pinch point 30.

Figure 5:
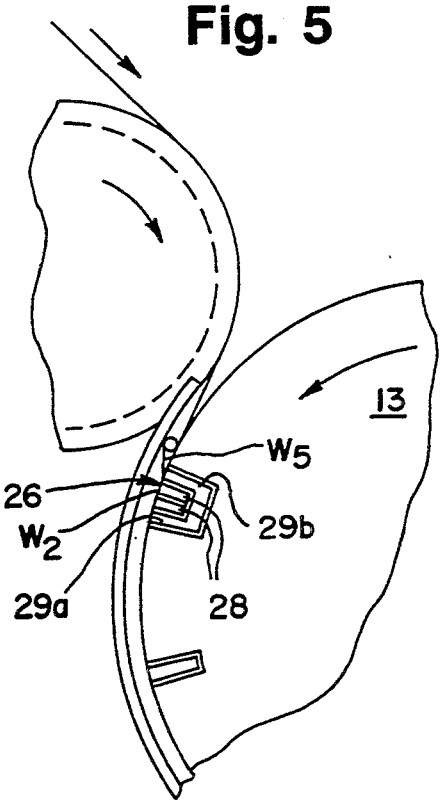
FIG. 5 is a view similar to FIG. 4 but even later in the winding cycle.

FIG. 4 illustrates what happens in the enveloping of the mandrel 15 by the web a short time later than that depicted in FIG. 3. There is a further leading edge portion of the web designated $W_3$ which is rearward in the direction of advance, i.e., upstream from the previously mentioned leading edge portion $W_2$. This leading edge portion $W_3$ is now in the process of being folded under the mandrel 15 as at $W_4$. Now referring to FIG. 5, the folded nature of the leading edge portion is seen more clearly and is designated $W_5$. This folded edge $W_5$ is lifted and rolled by the rubbing action of the web leading edge portion $W_2$ moving over it. The vacuum port means 26 is arranged to enhance this tendency by allowing the web leading edge portion to expose the first row of ports 29*a*, hence allowing the vacuum therein as well as that in port 29*b* to decay prior to the vacuum in the ports 28. This, in turn, allows the web leading edge portion $W_3$ to be attracted to the bedroll 13 while the folded leading edge portion $W_5$ is being released. Once the folded leading edge portion $W_5$ is raised off of the bedroll 13, it is trapped inside of the web leading edge portion $W_2$ by virtue of the rolling of the mandrel 15.

The geometry of the arcuate stationary plate 31 is arranged to allow for the rapid buildup diameter during the first part of the winding cycle. The gap 33 between the periphery of the bedroll 13 and the interior 31*c* of the stationery plate 31 (see particularly FIG. 1) gradually increases in proceeding from the upper inlet end where the mandrel 15 is being inserted until the outlet end 34 is reached. When the new log reaches the outlet end 34, it rolls off of the plate 31 and proceeds to wind between the first or upper winding drum 13 and the second or lower winding drum 17. As indicated previously, the remainder of the winding cycle generally follows that of a conventional surface winder in utilizing the rider roll 18, and inclined rolldown table 21.

As the log finishes winding, the next mandrel is inserted for transfer as the cycle repeats. The rider roll releases the finished log L''' which in turn rolls down an inclined exit table 21 to a roll strip conveyor generally designated 24. This conveyor is similar to the roll strip conveyor on co-owned U.S. Pat. No. 3,071,259. Once the log L''' has been stripped off of the mandrel 15, the gripper mechanism 22 lifts the mandrel 15 up onto the mandrel conveyor generally designated 35. One or more arms are provided along the length of the mandrel in order to help support the mandrel while it is being raised to the conveyor 35. The mandrel conveyor 35 then positions the mandrel to be received by the core inserter mechanism 14.

Among the advantages of the invention is the ability to operate a continuous running surface winder with recycled free mandrels and without the need for using adhesive or another means for adhering the web to the mandrel. A further advantage is the novel use of vacuum to hold both the feeding web and the web leading edge portion on the bedroll 13 to accomplish an enveloping transfer. This is further advantageous, again, in the elimination of adhesive or other means for maintaining the web in contact with the mandrel.

The invention also is advantageous in that an extensible material such as rubber, plastic and the like can be used as the material for construction of the mandrel 15 so as to facilitate roll stripping. Through the use of an extensible material, longitudinal elongation caused by the stripping forces is accompanied by a reduction in radius. The relationship of the two depends upon Poisson's ratio. In any event, the compressive grip of the convolutely wound web on the mandrel is successfully reduced and overcome by the stripping force in combination with the elongation and reduction in radius. Another advantageous function of the invention is the opportunity of using porting on the bedrolls to isolate one specific line of perforation so as to give an exact sheet count. Still further, the use of the long stationery plate is advantageous to permit a significant build up in diameter of the log before rolling in to the three roll cradle winding nip.

While in the foregoing specification a detailed description of an embodiment of the invention has been set down for the purpose of illustration, many variations in the details herein given may be made by those skilled in the art without departing from the spirit and scope of the invention.

We claim:

1. A method of coreless winding of webs into convolutely wound logs comprising the steps of continuously advancing a web for travel on a first winding drum, supporting a mandrel adjacent said first winding drum, applying a web directly to said mandrel, providing an arcuate stationary plate extending partway around said first winding drum and having an inlet and an outlet, said outlet being spaced further from said first winding drum than said inlet is spaced from said first winding drum to accommodate web buildup on said mandrel, winding said web to form a log between said first winding drum and a second winding drum, removing said log from said first and second winding drums and removing said mandrel from said log.

2. A surface winder comprising a frame providing a winding path, first winding drum means on said frame for continuously advancing a web in said path and positioned on one side thereof, means on said frame for introducing mandrels sequentially into said path for contact with said web, second winding drum means on said frame on the other side of said path for coaction with said first winding drum means in developing a convolutely wound log of said web, and means on said frame for stripping each mandrel sequentially out of its associated log, and means operably associated with said frame for enveloping each said mandrel with said web.

3. The winder of claim 2 in which means are operably associated with said frame for recycling said mandrels from said stripping means directly to said introducing means.

4. The winder of claim 2 in which said enveloping means includes an arcuate stationary plate on said frame extending partway around said first winding drum means.

5. A surface winder comprising: a frame, first, second and rider drums rotatably mounted in said frame and arranged in a three-drum cradle with a throat between said first and second drums; means for feeding a web for travel with said first drum, an arcuate stationary plate extending partway around said first drum and having an inlet and an outlet end; means for feeding a mandrel into said inlet end; said outlet end being positioned adjacent said throat and being spaced further from said first drum than said inlet end is spaced from said first drum to accommodate web buildup into a log on said mandrel; and means operably associated with said frame for axially removing said mandrel from said log buildup.

6. A surface winder comprising a frame providing a winding path, first winding drum means on said frame for continuously advancing a web in said path and positioned on one side thereof, means on said frame for introducing mandrels sequentially into said path for contact with said web, second winding drum means on said frame on the other side of said path for coaction with said first winding drum means in developing a convolutely wound log of said web, and means on said frame for stripping each mandrel sequentially out of its associated log, said frame being equipped with means for rotating said first drum about the axis thereof, said first drum being equipped with axially extending vacuum port means in surface thereof, and control means for correlating the rotation of said first drum with the means for feeding a mandrel into said inlet end when said vacuum means is adjacent said inlet end.

7. The surface winder of claim 6 in which said frame includes means for perforating said web along longitudinally spaced lines of transverse perforation, said first drum being equipped with second axially extending vacuum port means spaced circumferentially forwardly in the direction of first drum rotation of the first mentioned port means, said second port means cooperating with a mandrel at said inlet end to tension said web therebetween to snap said web along a-line of perforation.

8. The surface winder of claim 6 in which said port means includes primary and secondary port means, said primary port means being flanked circumferentially by said second secondary port means for sequentially releasing force on a leading edge portion of a severed web incident to enveloping a mandrel.

9. A method of coreless winding of webs into convolutely wound logs comprising the steps of continuously advancing a web for travel on a first winding drum, supporting a unitary mandrel adjacent said first winding drum, applying a web directly to said mandrel, providing a second winding drum adjacent said first winding drum, winding said web to form a log between said first winding drum and said second winding drum, removing said log from said first and second winding drums, removing the mandrel from said log to provide a coreless log having a small opening in the center thereof, and directly recirculating said mandrel to a position for a further supporting step.

10. The method of claim 9 in which said mandrel removing step includes providing a mandrel having an axial length sufficient to project beyond said log at least at one end of said mandrel, gripping said mandrel one end at a spaced distance from said log, inserting a stripping means in said spaced distance and moving said stripping means axially sufficient to desleeve said log from said mandrel.

11. The method of claim 10 in which said recirculating step includes gripping a mandrel from which a log is being desleeved, moving said mandrel through a path extending between a stripping position and a supporting position adjacent said first winding drum.

12. A method of coreless winding of webs into convolutely wound logs comprising the steps of continuously advancing a web for travel on a first winding drum, supporting a mandrel adjacent said first winding drum, providing means for enveloping said mandrel with said web, applying a web directly to said mandrel and enveloping said mandrel with said web, providing a second winding drum adjacent said first winding drum, winding said web to form a log between said first winding drum and said second winding drum, removing said log from said first and second winding drums, and removing the mandrel from said log to provide a coreless log having a small opening in the center thereof.

* * * * *

UNITED STATES PATENT AND TRADEMARK OFFICE

CERTIFICATE OF CORRECTION

PATENT NO. : 5,421,536 
DATED : June 6, 1995
INVENTOR(S) : James E. Hertel, Gerald W. Buxton and Laurence J. Oliver It is certified that error appears in the above-identified patent and that said Letters Patent is hereby corrected as shown below:

Title page,
Item [73], Assignee, should be -- Paper Converting Machine Company --.

Signed and Sealed this

Fifteenth Day of November, 2005

JON W. DUDAS
*Director of the United States Patent and Trademark Office*